United States Patent [19]

Olsen

[11] Patent Number: 4,803,478

[45] Date of Patent: Feb. 7, 1989

[54] HORIZONTAL SCROLL METHOD AND APPARATUS

[75] Inventor: Richard Olsen, Littleton, Mass.

[73] Assignee: Prime Computer, Inc., Natick, Mass.

[21] Appl. No.: 831,715

[22] Filed: Feb. 21, 1986

[51] Int. Cl.[4] ..... G09G 1/16

[52] U.S. Cl. ..... 340/726; 340/724; 340/792

[58] Field of Search ..... 340/724, 726, 750, 799, 340/792

[56] References Cited

U.S. PATENT DOCUMENTS

| | | | |
|---|---|---|---|
| 3,643,252 | 2/1972 | Roberts, Jr. | 340/726 |
| 3,792,462 | 2/1974 | Casey et al. | 340/726 |
| 4,204,206 | 5/1980 | Bakula et al. | 340/799 |
| 4,404,554 | 9/1983 | Tweedy, Jr. et al. | 340/726 |
| 4,437,093 | 3/1984 | Bradley | 340/724 |
| 4,520,356 | 5/1985 | O'Keefe et al. | 340/750 |
| 4,663,617 | 5/1987 | Stockwell | 340/726 |
| 4,694,406 | 9/1987 | Shibui et al. | 340/726 |

*Primary Examiner*—Gerald L. Brigance
*Assistant Examiner*—Mahmoud Fatahi-yar
*Attorney, Agent, or Firm*—Wolf, Greenfield & Sacks

[57] ABSTRACT

A horizontal scrolling apparatus that provides scrolling on a character-by-character basis including a screen memory and associated visual attribute memory having associated therewith a scroll control memory for storing at least one bit for controlling horizontal scrolling. A latch controls writing into the scroll control memory to provide an enable bit therein, only in those locations corresponding to characters that are to be scrolled. An offset number is stored in an offset register, which number is variable under computer control. Operation of an adding circuit is responsive to sensing of the enable bit for adding the offset number to the present screen address to provide an offset address. The offset address is coupled to the video memory for display of the character associated with the offset address in the screen address position.

12 Claims, 3 Drawing Sheets

HORIZONTAL SCROLL METHOD AND APPARATUS

BACKGROUND OF THE INVENTION

The present invention relates in general to a graphic and alpha-numeric display used in association with a computer system. More particularly, the invention relates to a horizontal scrolling technique that permits bi-directional scrolling on a character-by-character resolution basis.

Conventional horizontal scrolling techniques rely on software-based raster operations. With these software controlled techniques, scrolling is carried out only on a line-by-line basis. The disadvantage of this conventional software technique is that it requires the removal and repositioning of significant amounts of data from memory.

Accordingly, it is an object of the present invention to provide an improved horizontal scrolling technique that now permits scrolling on a character-by-character basis.

Another object of the present invention is to provide an improved horizontal scrolling method and apparatus in which relatively simple hardware components are employed in place of extensive software control to thereby minimize data manipulation in memory.

SUMMARY OF THE INVENTION

To accomplish the foregoing and other objects, features and advantages of the invention, there is provided, in a computer system having a video display screen, apparatus for providing horizontal scrolling on a character-by-character basis. The apparatus of the invention generally comprises a video memory means that stores multiple data words corresponding to a greater number than screen character locations and including, associated with each data word, n attribute bits for defining various characteristics associated with the character with which the attribute bits are associated. Scroll control memory means is provided associated with the video memory means for storing at least bit n+1 for controlling horizontal scrolling on a character-by-character basis. Means are provided for writing into the scroll control memory means an enable bit, only in those locations corresponding to characters that are to be scrolled. The writing means may include a latch circuit that is under microprocessor control and which in the disclosed embodiment is adapted to write a "1" into each address that is to be scrolled. Means are provided for establishing an offset number. This may include an offset register, the contents of which are under microprocessor control. Associated with the offset register may be an offset enable flip-flop and means for coupling the output of the scroll control memory means to the offset enable flip-flop. Means are provided responsive to a sensing of the enable bit from the scroll control memory means for adding the offset number to the present screen address to provide an offset address. The present screen address comes from a counter of the video controller. The present screen address is indicative of the present position at which a character is to be written on the screen. Finally, means are provided for coupling the offset address to the video memory means for display of the character associated with the offset address in the screen address position. Separate storage means are also provided for receiving the output of the scroll control memory means for the purpose of maintaining track of whether a character has the ninth bit set or not. The separate storage means may be the computer status register.

In the embodiment of the invention disclosed herein, the number of stored data words is twice the number of screen character locations. The data words correspond substantially to 160 characters by 25 lines. On the other hand, the screen character locations correspond substantially to 80 characters by 25 lines. Thus, there may be a scrolling of up to 80 character positions. The video memory means preferably includes a screen memory of substantially 4096 bits deep by 8 bits wide with the 8 bits defining the data word. The visual attribute memory may also be of substantially 4096 bits deep by 8 bits wide with the video and attribute memories being commonly addressed. The scroll control memory means may be of substantially 4096 bits deep by 1 bit wide with the scroll control memory means likewise being commonly addressed with the video and attribute memories.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

In accordance with the present invention, there is described herein, a technique for horizontal scrolling in connection with a computer system having a video display screen. The horizontal scrolling is provided in accordance with the invention on a character-by-character basis and in accordance with the control of the invention, scrolling may be accomplished on a line-by-line basis, a segment of a line basis, or a character-by-character basis.

Figure 1:
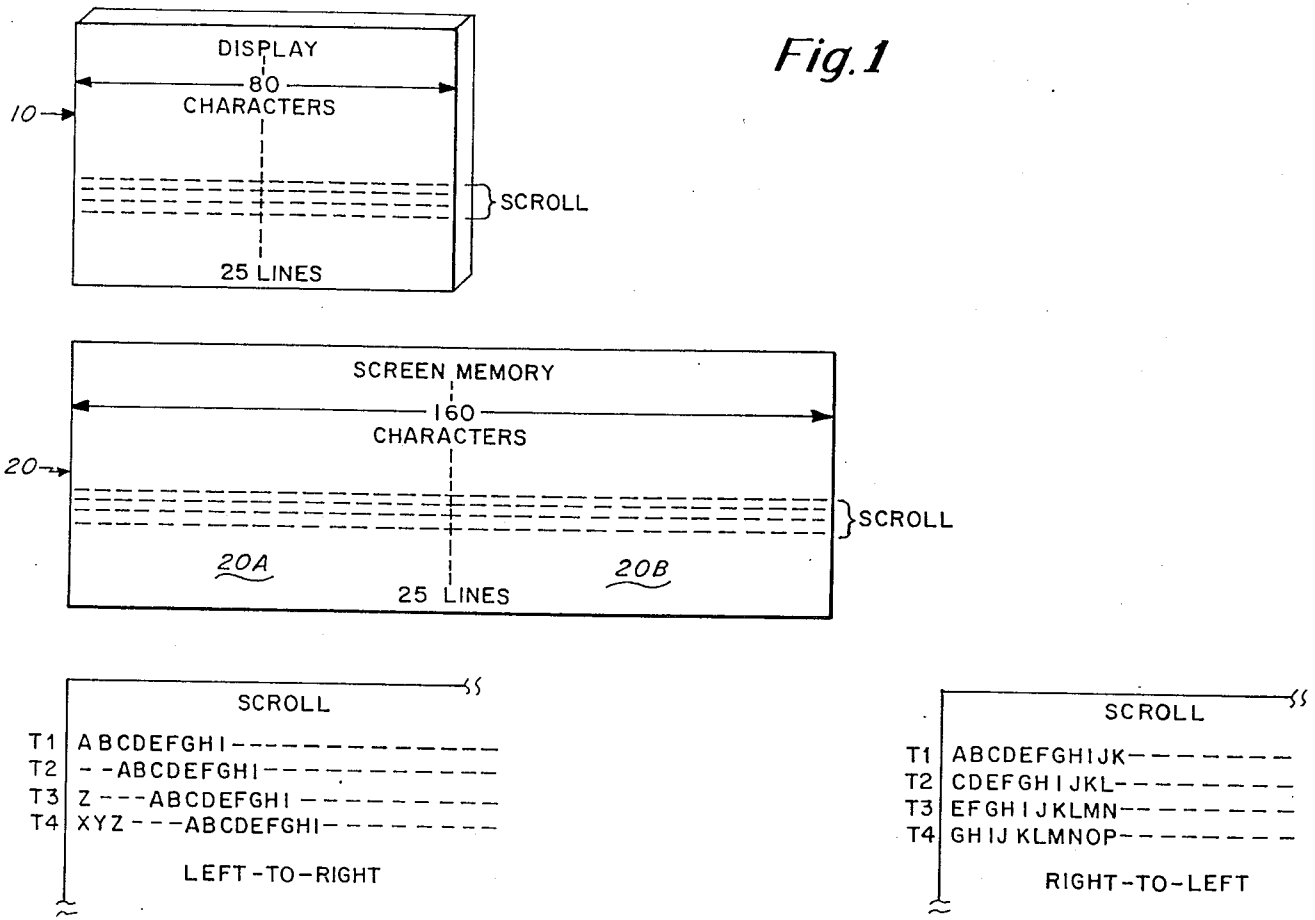
FIG. 1 is a schematic diagram illustrating display and screen memory capacity along with examples of bidirectional scrolling.

For a better understanding of the use of horizontal scrolling, reference is now made to FIG. 1 that illustrates in schematic fashion, the display screen 10, the screen memory 20 and two examples illustrating both left-to-right and right-to-left scrolling. In this connection in accordance with the invention, the control may be operated so as to provide either direction of scrolling and to also provide selective scrolling on a line, segment of line, or character basis.

The display screen 10, as illustrated in FIG. 1, has a capacity of 80 characters per line with a total number of lines of 25. For sake of illustration, a few of the lines are illustrated as being lines that are controlled to be horizontally scrolled.

FIG. 1 also shows the screen memory, which may be considered as separated into two segments 20A and 20B. the total screen memory has 25 lines each of 160 characters. FIG. 1 also illustrates the scrolled lines in association with the screen memory. With regard to the screen memory, it is noted that only one-half of the screen memory, such as segment 20A is displayable on the display screen 10. The other segment 20B when selected, may be horizontally scrolled so as to bring additional data onto the display screen. With the arrangement of FIG. 1, there can be horizontal scrolling of up to 80 characters.

FIG. 1 also schematically illustrates both left-to-right and right-to-left scrolling illustrated on a timed basis. Note the time intervals T1–T4. Thus, in FIG. 1 the illustration is of a single line with the multiple entries being for different time periods. For example, the time period T2 is a time period in which the characters have been scrolled to the right by two character spaces in comparison with the time period T1. The right-to-left scrolling illustrated in FIG. 1 is the form that is described in further detail in connection with FIG. 2.

Figure 2:
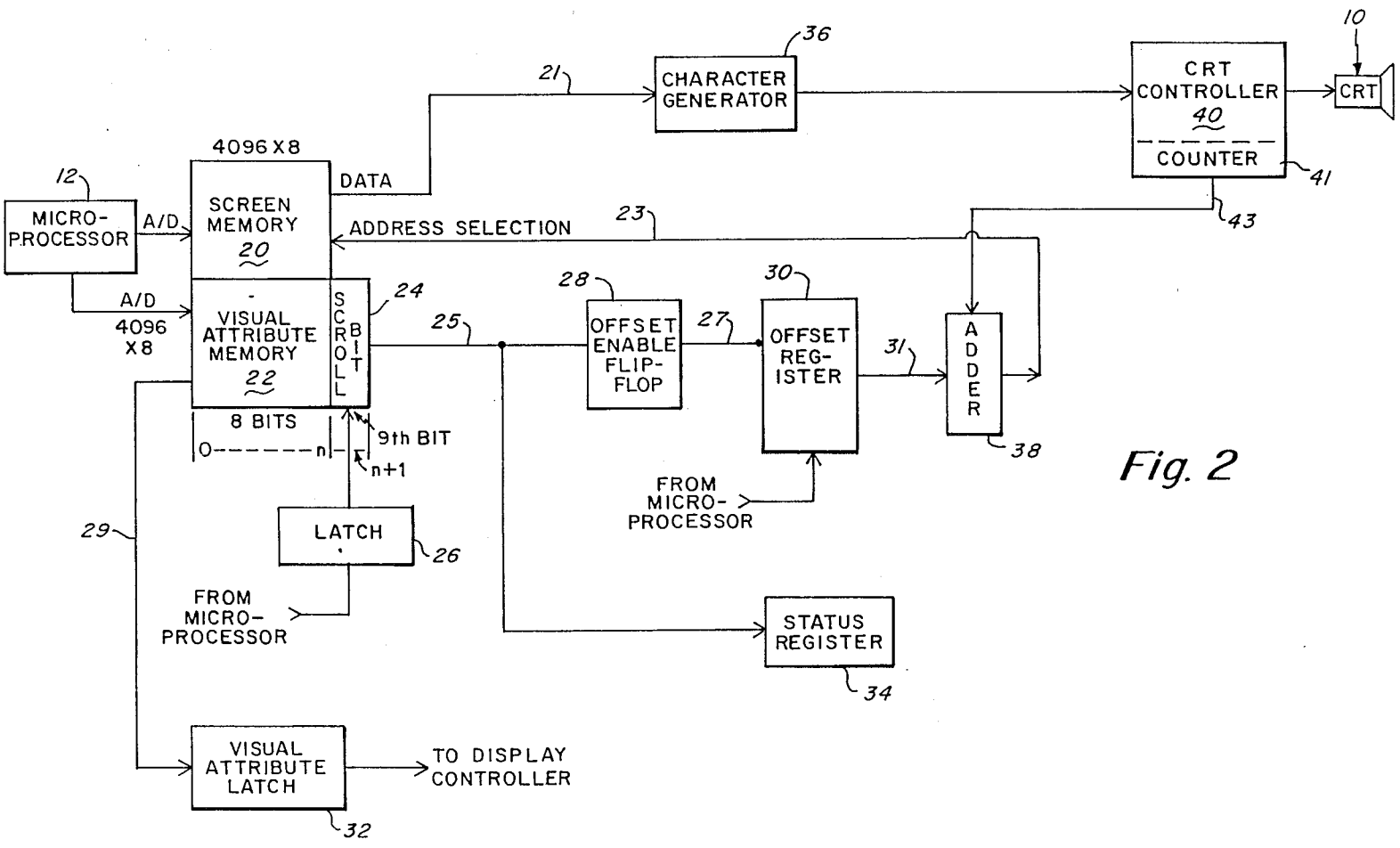
FIG. 2 is a block diagram of a system in accordance with the present invention for providing horizontal scrolling.

Referring now to FIG. 2, there is illustrated a block diagram of a system in accordance with the present invention. The horizontal scrolling is of data that appears on a video display screen illustrated in FIG. 2 by the CRT display 10. FIG. 2 illustrates the horizontal scroll circuitry in block form.

In FIG. 2 there is illustrated the video memory which is comprised of a screen memory 20 and an associated visual attribute memory 22. Both memories 20 and 22 are of 4096 bits deep by 8 bits wide, thus providing 8 bits for a data word and an associated 8 attribute bits. A 9th attribute bit is added to the visual attribute bus where the first 8 bits are used for character generation control. The 9th bit, as illustrated in FIG. 2, stores the horizontal scroll information and is illustrated in FIG. 2 as a scroll control memory 24. This is provided in the form of a 4K by 1 static RAM. Data fetched out of the address specified for visual attributes carries with it this bit from the 4K by 1 memory 24 because the same address is presented thereto.

Output data from the memory 24 at line 25 is latched and directed to an adder circuit that will be discussed in further detail hereinafter. With regard to data inputted to the memory 24, there is provided a latch 26 that is controlled to write into the scroll control memory 24, an enable bit only in those locations corresponding to characters that are to be scrolled. In the example illustrated herein, the scroll bit is set to a "1" for indication of scrolling.

When the CRT accesses the screen memory 20, the corresponding address in the scroll control memory 24 is read. If that address contains a "1", then the character may be scrolled by the amount loaded into the offset register 30 (see FIG. 2). This allows large screen areas to be scrolled, merely by setting the latch 26, and then reading and rewriting the desired visual attribute location (bit 9). When no further definition of scrolling regions is required, the latch 26 is simply reset. Software is used to determine whether a character has a 9th bit set. The output of the memory 24 may be transferred for storage purposes to a spare bit in the status register 34. This allows data from a previous read of attribute memory to appear in the status register.

Now, with more specific reference to FIG. 2, it is noted that, associated with the screen memory 20 and visual attribute memory 22, is the microprocessor 12. As indicated in FIG. 2, data and address communication occurs between the microprocessor 12 and both the screen memory 20 and visual attribute memory 22. Thus, by way of the microprocessor 12, data in the screen memory 20 and associated visual attribute data in the memory 22 may be altered under direct computer control.

FIG. 2 also shows data output on line 29 to the visual attribute latch 32. The latch 32 receives in sequence visual attribute codes from the memory 22 and coupled these codes to the display controller for control of the display in a conventional manner in accordance with the visual attribute associated with a particular code.

As far as outputting from the screen memory 20 is concerned, in FIG. 2, there is illustrated the output data line 21 which couples by way of the character generator 36 to the CRT controller 40. The CRT controller 40 controls the CRT display 10.

In FIG. 2 the block diagram is of simplified construction and as such, does not show all of the timing signals that are typically associated with video control. Also, for the sake of simplicity, only a character generator 36 is illustrated it being understood, however, that both character and graphic generators may be employed for controlling writing on the CRT screen.

Also associated with the screen memory 20 is the address selection line 23 that provides an address for the screen memory 20. When a particular address is selected, then the associated data stored in that address is coupled on line 21 for display on the CRT screen. The address on line 23 is coupled from the output of the adder circuit 38.

With regard to the adder circuit 38, it is noted that there are two inputs thereto. One input is from the counter 41 of the CRT controller 40. The signal couples on line 43 to one input of the adder circuit 38. The other input to the adder circuit 38 is taken from the offset register 30. The offset register 30 is enabled from a signal on line 27 coupled from the offset enable flip-flop 28. The offset enable flip-flop 28 is in turn controlled from the signal on line 25 taken at the output of the scroll control memory 24.

As indicated previously, the operation of the latch 26 controls the writing into the scroll control memory 24. In other words, this controls the writing of the form of the 9th bit also referred to as bit $n+1$. It is noted in FIG. 2 that the input to the latch 26 is taken from the microprocessor. The operation of the latch 26 is under software control from the microprocessor. In one embodiment in accordance with the invention, the inputting of data to the memory 24 requires that the latch 26 be set with a "1" output. As long as the latch 26 is set, this "1" output is stored in each of the memory 24 locations at which horizontal scrolling is desired. When no further definition of scrolling regions is desired, the latch is reset so as to inhibit further enabling of areas where scrolling is not to take place.

Thus, the output signal on line 25 from the memory 24 is either a "1" or a "0", depending upon whether horizontal scrolling is to take place or not. In the instance wherein the output of the memory 24 is a "0", then the offset enable flip-flop 28 is not set and the offset register 30 is not enabled. This means that the input to the adder 38 from the offset register 30 essentially stays as a "0" input and thus the counter address on line 43 passes through the adder circuit 38 and appears at the output line 23 as the same address for selection of the appropriate screen memory location. Thus, for this type of operation, and assuming that the contents of the screen memory 20 do not change under CPU control, then the same display occurs each vertical refresh cycle of the CRT screen.

Now, in the alternate mode of operation, when a "1" is written into the memory 24 at a particular location, then horizontal scrolling can occur under control of the offset register 30. In this connection, it is noted that the offset register 30 is controlled from the microprocessor 12 and has an offset number set thereinto under software control from the microprocessor. This offset number is selectively incremented or decremented as will be discussed in further detail hereinafter.

Now, when the 9th bit from the scroll control memory 24 is a "1", the signal on line 25 sets the offset enable flip-flop 28 and the output thereof on line 27 provides for an enabling of the offset register 30. The number set in the offset register 30 under control of the microprocessor, is coupled on the output line 31 to one input of the adder 38.

The other input to the adder circuit 38 is at line 43 from the CRT counter 41. The output on line 23 from the adder circuit 38 represents the sum of the addresses on the two input lines.

By way of example, assume that the location X in FIG. 1 corresponds with an address 800. This means that the address number on line 43 coupled to the adder circuit 38 is the number 800. If it is furthermore assumed that the offset number is number 3, then the output of the adder circuit 38 is the address 803.

Thus, while the counter 41 is indicating a screen position (position X, FIG. 1) which is at the beginning of one of the lines that is being scrolled, the address that is interrogated by virtue of the signal at line 23 in the screen memory 20 is address 803 which is an address displaced three locations, thus in essence moving or scrolling the characters on that particular line. The magnitude of the count or number in the offset register 30 determines the extent of scrolling.

If an entire line is being scrolled, which is a common occurrence, then, as each address comes up, the same offset is used so that the net effect is that the display moves to the left three character spaces in the previous example.

Figure 3:
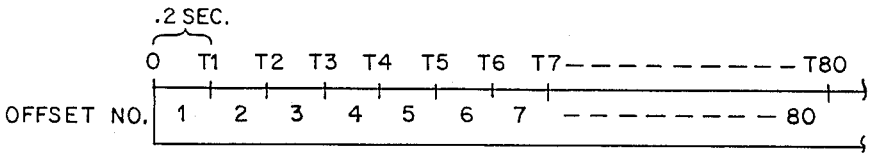
FIG. 3 is a simplified diagram illustrating one example of offset number selection and period of offset number change.

With respect to the previous example, it is noted that consideration has been given to a particular offset so as to essentially translate the character or in the example given, the entire line by three character spaces. Assuming that the entire line is to be scrolled or in fact a series of lines such as illustrated in FIG. 1, then the number in the offset register is periodically updated and periodically increased. An illustration of this is given in FIG. 3 which shows the offset number as progressively increasing by single integers. The timing scale illustrates time intervals from 0 through T80 in 0.2 second increments. Thus, the offset number changes every 0.2 seconds. The screen period on a vertical refresh is 16.6 milliseconds and thus for each time interval of FIG. 3, there are approximately 12 screen scans. The offset then increases to an offset number of two for the next 0.2 seconds until all 80 characters have been scanned. In the example given, this takes 16 seconds, which may be a relatively slow scan speed. FIG. 3 is given only for the purpose of illustration in showing how offset numbers are progressively increased to provide the continuous horizontal scrolling. The offset numbers may be increased in any increments.

In accordance with the present invention, as illustrated previously in FIG. 1, the scrolling can occur in either direction. For left-to-right scrolling the same adder circuit 38 may be used with the counter 41 address being altered by the offset address by a negative addition (decrementing address). Other than this change, the operation is substantially the same with the offset register still being employed in the same manner with the bit control from the memory 24.

Having now described one preferred embodiment of the present invention, it should now be apparent to those skilled in the art that numerous other embodiments and modifications thereof are contemplated as falling within the scope of the present invention as defined by the appended claims. For example, there has been described herein a system in which a binary "1" indicates horizontal scrolling. In an alternate embodiment of the invention, a binary "0" could be used to indicate horizontal scrolling.

What is claimed is:

1. In a computer system having a video display screen and means for providing the present screen address, apparatus for providing horizontal scrolling on a character-by-character basis, said apparatus comprising:

video memory means having means for storing multiple data word corresponding to a greater number than screen character locations and including, associated with each data word, n attribute bits for defining various characteristics associated with the character with which the attribute bits are associated, scroll control memory means associated with said video memory means for storing at least bit n+1 for controlling horizontal scrolling on a character-by-character basis, one of the states of said bit indicating horizontal scrolling of that character and the other state of said bit indicating non-scrolling, means coupled to an input of said scroll control memory means, for writing into said scroll control memory means an enable bit only in those locations corresponding to characters that are to be scrolled, means for establishing an offset number under computer control and including an offset register having an enable input, means coupled from said scroll control memory means to the offset register enable input to enable said offset register when the enable bit is in said horizontal scrolling state, adder means coupled from said offset register for adding said offset number from said offset register to the present screen address to provide an offset address, and means for coupling the offset address to the video memory means for display of the character associated with the offset address in the screen address position.

2. Apparatus as set forth in claim 1 wherein the number of stored data words is twice the number of screen character locations.

3. Apparatus as set forth in claim 2 wherein the data words correspond substantially to 160 characters by 25 lines.

4. Apparatus as set forth in claim 3 wherein the screen character locations correspond substantially to 80 characters by 25 lines.

5. Apparatus as set forth in claim 1 wherein said video memory means includes a screen memory of substantially 4096 bits deep by 8 bits wide, said 8 bits defining said data word.

6. Apparatus as set forth in claim 5 including a visual attribute memory of substantially 4096 bits deep by 8 bits wide, with said video and attribute memories being commonly addressed.

7. Apparatus as set forth in claim 6 wherein said scroll control memory means is of substantially 4096 bits deep by 1 bit wide, with said scroll control memory means likewise being commonly addressed with the video and attribute memories.

8. Apparatus as set forth in claim 1 wherein said means for writing into said scroll control memory means includes a latch circuit under microprocessor control for writing a "1" into each address that is to be scrolled.

9. Apparatus as set forth in claim 1 wherein said means coupled from said scroll control memory means to the offset register enable input includes an offset enable flip-flop.

10. Apparatus as set forth in claim 1 including separate storage means for receiving the output of the scroll control memory means.

11. Apparatus as set forth in claim 1 wherein said means for establishing an offset number further includes means for periodically changing the offset number in said offset register at a predetermined rate to establish a predetermined scrolling rate.

12. Apparatus as set forth in claim 11 wherein said means coupled from scroll control memory means to the offset register enable input of the offset register comprises an offset enable flip-flop that is set by the enable bit of said horizontal scrolling state with the output of said offset enable flip-flop coupling to the enable input of said offset register for enabling said offset register.

* * * * *